US005224236A

United States Patent [19]

Sallquist

[11] Patent Number: 5,224,236

[45] Date of Patent: Jul. 6, 1993

[54] MACHINE FOR CLEANING PAVED SURFACES

[76] Inventor: Robert V. Sallquist, 735 La Honda Rd., Woodside, Calif. 94062

[21] Appl. No.: 745,938

[22] Filed: Aug. 16, 1991

[51] Int. Cl.[5] ..... B08B 3/02

[52] U.S. Cl. ..... 15/321; 15/340.1; 15/353; 126/271.1

[58] Field of Search ..... 15/320, 321, 340.1, 15/353; 126/271.1, 343.5 R

[56] References Cited

U.S. PATENT DOCUMENTS

| | | | |
|---|---|---|---|
| 3,262,146 | 7/1966 | Hays | 15/321 |
| 3,439,374 | 4/1969 | Wisdom | 15/321 |
| 3,902,219 | 9/1975 | Jones | 15/321 X |
| 4,183,116 | 1/1980 | Thompson | 15/340.1 X |
| 4,327,459 | 5/1982 | Gilbert | 15/321 |
| 4,336,627 | 6/1982 | Bascus | 15/321 |
| 4,443,909 | 4/1984 | Cameron | 15/321 X |
| 4,466,155 | 8/1984 | Grave | 15/321 |

*Primary Examiner*—Chris K. Moore
*Attorney, Agent, or Firm*—Flehr, Hohback, Test, Albritton & Herbert

[57] ABSTRACT

Machine for removing residues such as oil, grease and diesel fuel spills from streets, parking lots and other paved surfaces. The machine comprises a mobile supporting vehicle having water supply and recovery tanks forming an integral part thereof. A steam generator is mounted on the vehicle for heating water from the supply tank to produce highly pressurized hot water and steam, and a hose and wand are connected to the steam generator for directing the pressurized water and steam against a surface to be cleaned. A pick-up wand and hose are connected to the recovery tank, and a vacuum pump is connected to the recovery tank for drawing water and residue from the surface through the pick-up wand and hose to the recovery tank. A filter is provided at the inlet of the recovery tank for removing particulate residue from the recovered water, and excess residue is bypassed around this filter to prevent the residue from backing up into the pick-up hose and clogging the hose when the filter is full. If desired, and agent such as a detergent, a degreaser or a coalescent can be added to the pressurized water to enhance the cleaning action.

12 Claims, 5 Drawing Sheets

MACHINE FOR CLEANING PAVED SURFACES

This invention pertains generally to the cleaning of paved surfaces such as streets, parking lots and the like and, more particularly, to a machine which is particularly suitable for removing oil, grease and other residue including diesel fuel spills from such surfaces.

One of the problems in maintaining roadways, parking lots and other paved areas in which motor vehicles travel is removing the residue of oil, grease and other debris which can collect on the surfaces of such areas.

The most common types of street cleaning machines heretofore provided have large brushes which sweep up debris and may also provide some scrubbing action. Such machines are not, however, very effective in removing residues such as oil and grease which can collect in interstices and other voids in paved surfaces.

Another type of street cleaning machine is described in U.S. Pat. No. 3,193,867. This machine provides a combination of a vacuuming system for debris pickup and collection and a sprinkling system for street sprinkling and flushing. A single tank is utilized for collecting the debris picked up in a vacuuming operation and for storing the water for a sprinkling operation. After a vacuuming operation, the tank must be emptied, filled with water and reconnected for use in sprinkling. This type of machine is even less effective than the brush type of machine in removing residues such as oil and grease from the pavement.

It is in general an object of the invention to provide a new and improved machine for cleaning streets, parking lots and other paved surfaces.

Another object of the invention is to provide a machine of the above character which is particularly suited for removing oil and grease residues from paved surfaces.

These and other objects are achieved in accordance with the invention by providing a mobile supporting vehicle having water supply and recovery tanks forming an integral part thereof, a steam generator mounted on the vehicle for heating water from the supply tank to produce highly pressurized hot water and steam, means connected to the steam generator for directing the pressurized water and steam against a surface to be cleaned, pick-up means connected to the recovery tank and adapted to be positioned in proximity to the cleaned surface, and vacuum forming means connected to the recovery tank for drawing water and residue from the surface through the pick-up means to the recovery tank. A filter is provided at the inlet of the recovery tank for removing particulate residue from the recovered water, and this filter includes means for bypassing excess residue around the filter to prevent the residue from backing up into the pick-up hose and clogging the hose when the filter is full. If desired, and agent such as a detergent, a degreaser or a coalescent can be added to the pressurized water to enhance the cleaning action.

Figure 1:
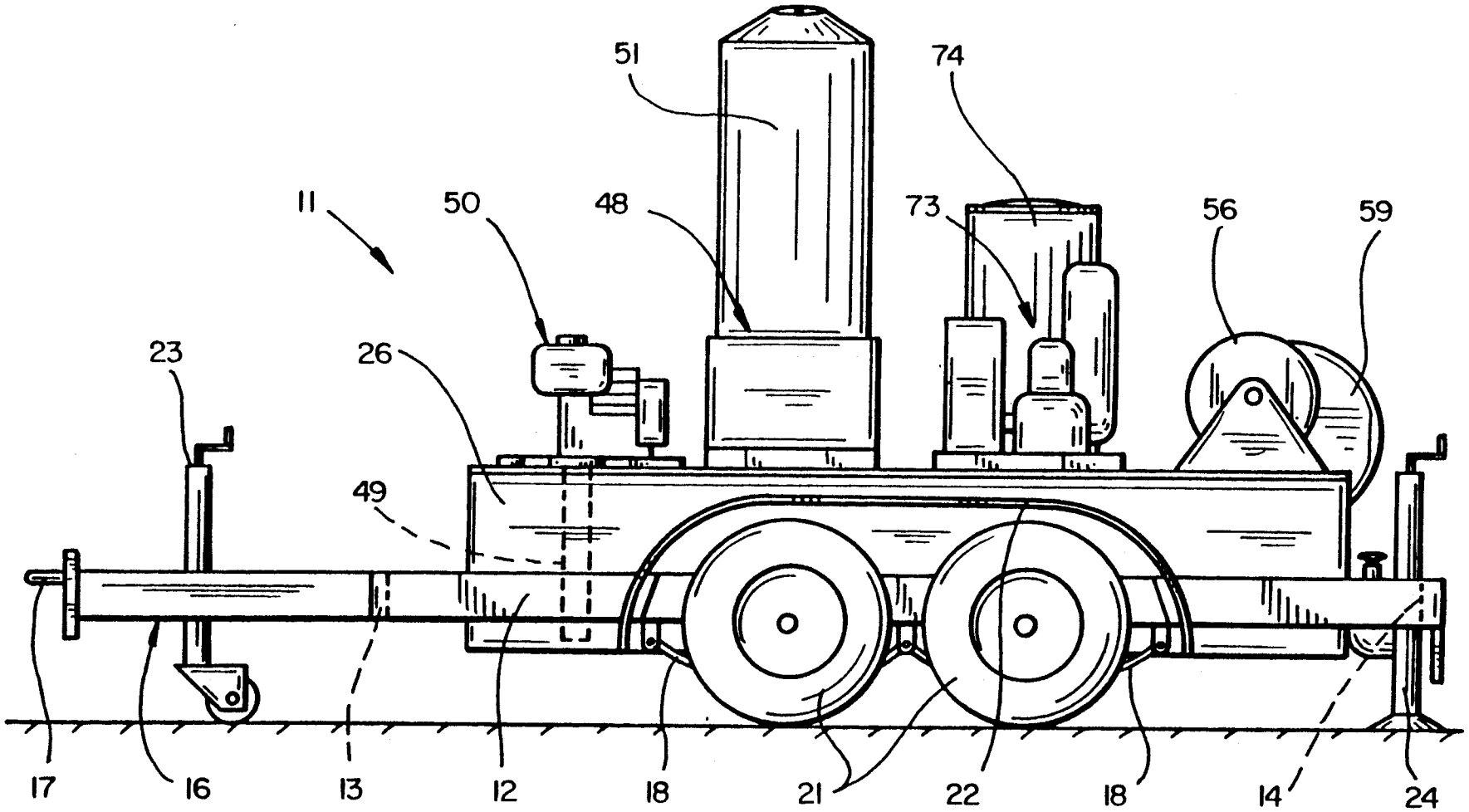
FIG. 1 is a side elevational view, somewhat schematic, of one embodiment of a machine for cleaning paved surfaces in accordance with the invention.

As illustrated in the drawings, the machine includes a mobile support vehicle 11 in the form of a double axle trailer having an integral frame and body structure. The frame includes a pair of longitudinally extending side members or rails 12, a front cross member 13, a rear cross member 14, and a tongue 16 with a hitch ring 17 for connection to a truck or other towing vehicle (not shown). The frame members are fabricated of a suitable material such as steel channel and are welded together. The frame is supported by leaf springs 18 on axles 19 on which wheels 21 are mounted. Fenders 22 for the wheels are mounted on the side rails, and the axles are stepped down around the body of the trailer to permit a lower center of gravity.

A wheeled tongue jack 23 is mounted on the frame near the hitch ring and a pair of jack stands or levelers 24 are provided toward the rear of the frame. The tongue jack facilitates connection and disconnection of the trailer and towing vehicle as well as movement of the trailer when separated from the towing vehicle, and the jack stands permit the trailer to rest in a stable, level position when disconnected from the towing vehicle.

The body of the trailer comprises a water supply tank 26 and a water recovery tank 27 which are positioned side-by-side between the side rails and are rigidly affixed to the rails and to each other to form a unitary structure. The tanks are elongated and rectangular and extend substantially the entire length of the trailer.

Figure 2:
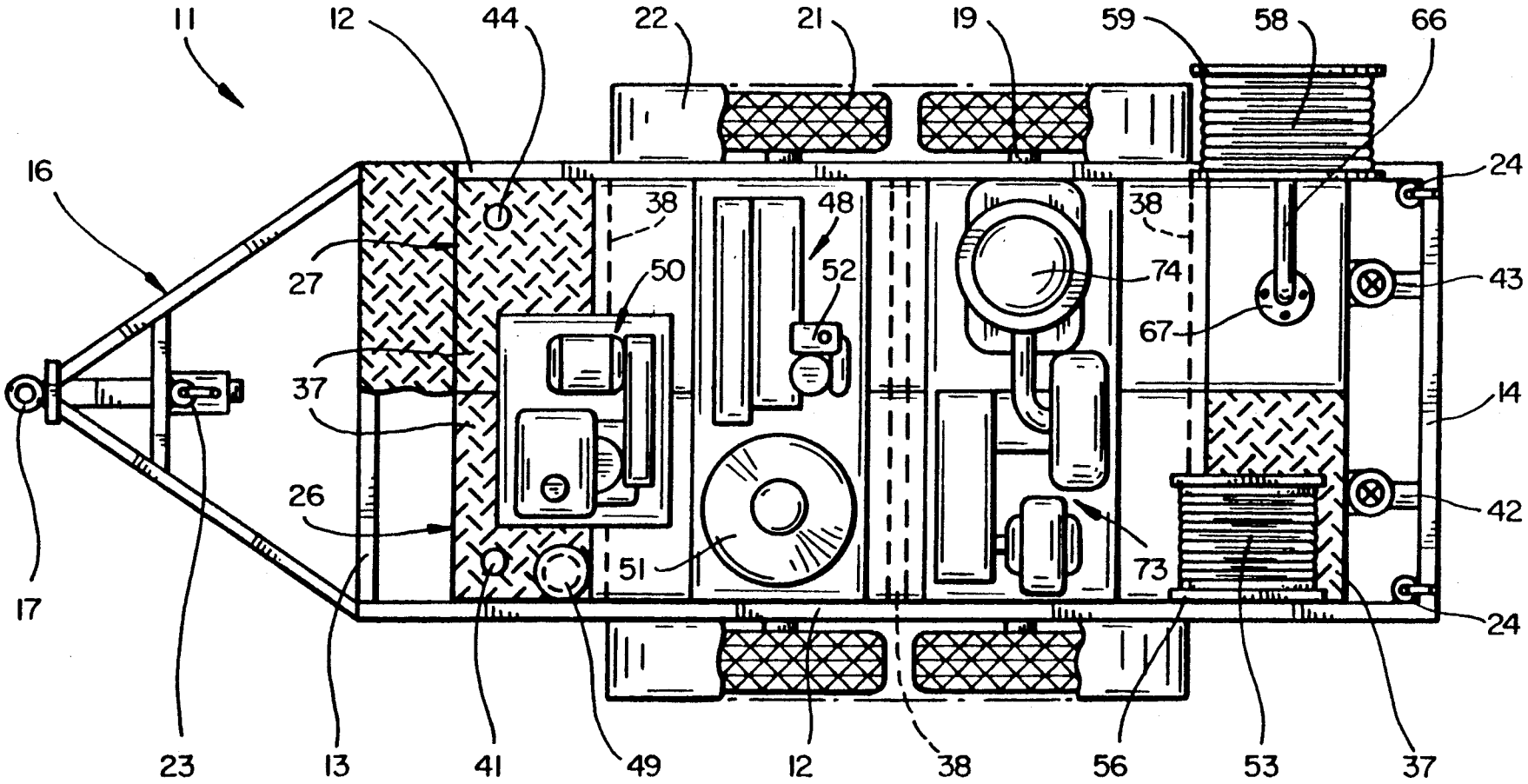
FIG. 2 is a top plan view of the embodiment of FIG. 1.
Figure 3:
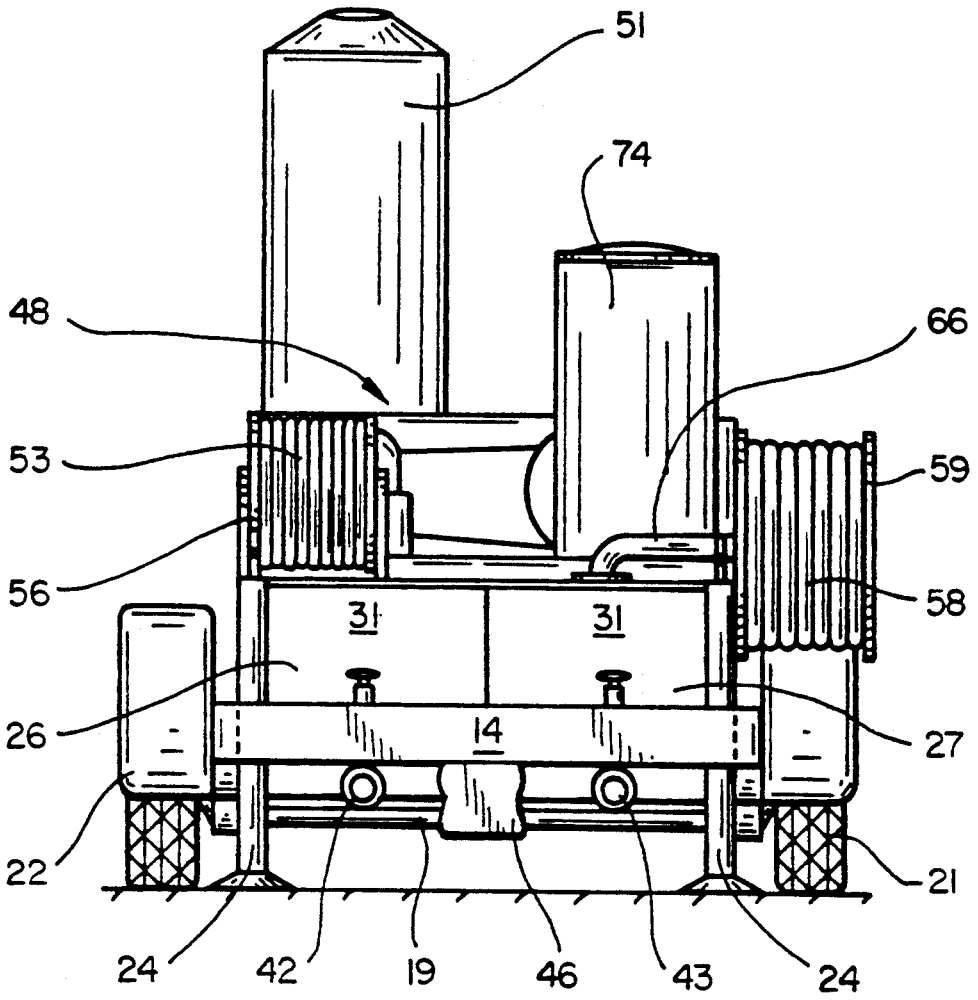
FIG. 3 is an end view, partly broken away, of the embodiment of FIG. 1.
Figure 4:
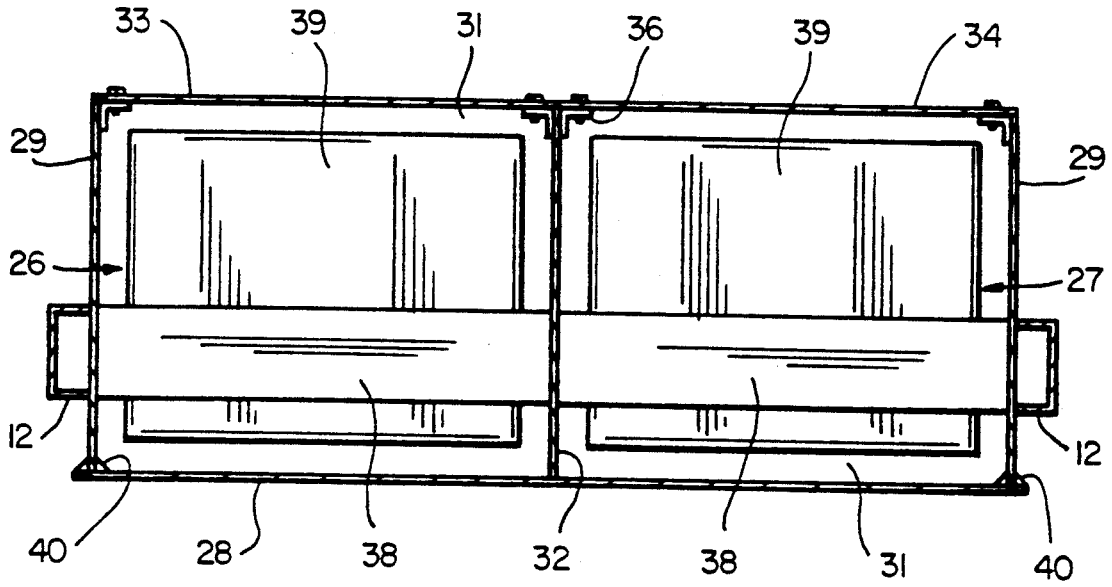
FIG. 4 is a cross-sectional view of the water supply and recovery tanks in the embodiment of FIG. 1.

As best illustrated in FIG. 4, the tanks themselves are formed as a unitary structure with a bottom plate 28, side walls 29, end walls 31 and a center divider 32 which extends longitudinally between the end walls and forms a common side wall for the two tanks. Top covers 33, 34 are bolted to angle irons 36 which are welded along the upper edges of the side and end walls and the center divider. As best seen in FIG. 2, the top covers include removable panels 37 toward the ends of the tanks to permit access to the interiors of the tanks for cleaning and other maintenance. The tanks are fabricated of a heavy, rigid material such as ¼ inch steel plate.

The side walls of the tank structure are welded to the side rails of the frame, and cross members 38 are welded to the side walls and the center divider between the side rails and serve to further stiffen the structure. Transversely extending baffle plates 39 are mounted on the cross members to reduce sloshing of the water in the tanks, and gussets 40 strengthen the joints between the side wall and the bottom plate.

Water supply tank 26 has a filling port 41 toward the front end of its top cover and a drain valve 42 in the end wall toward the rear of the trailer. Water recovery tank 29 has a drain valve 43 in its rear wall and a flushing port 44 toward the front end of its top cover. A safety plate 46 is mounted on the rear cross member of the frame to protect the valves from damage as the trailer is moved about.

A steam generator 48 is mounted on the trailer for heating water from the supply tank to provide highly pressurized hot water and steam. The steam generator is positioned on top of the tanks, and water is supplied to it by a submersible pump 49 in the supply tank. The pump is powered by electricity from a gasoline powered generator 50 mounted on the tanks. The steam generator includes a boiler 51 which heats the water and a pump 52 which pressurizes the heated water. In one presently preferred embodiment, the boiler has a burner which burns diesel fuel, and the pump is a three-stage pump, driven by a gasoline engine, which increases the pressure of the heated water to approximately 2200–2500 psi. The output of the steam generator consists of a combination of steam and pressurized water at a temperature slightly below that of the steam.

The output of the steam generator is connected to a hose 53 which has a wand 54 at the distal end thereof with one or more nozzles for directing the pressurized water and steam against the surface to be cleaned. When not in use the hose is stored on a reel 56 mounted on the supply tank toward the rear of the trailer. The hose can be of any suitable length, e.g. 50 feet.

Means is provided for recovering the condensed steam and water from the paved surface as well as any residue or debris which is dislodged from the surface by the water.

This means includes a pick-up wand 57 connected to a pick-up hose 58 which is connected to an inlet to the recovery tank. When not in use, the pick-up hose is stored on a reel 59 mounted on the side of the recovery tank.

Figure 5:
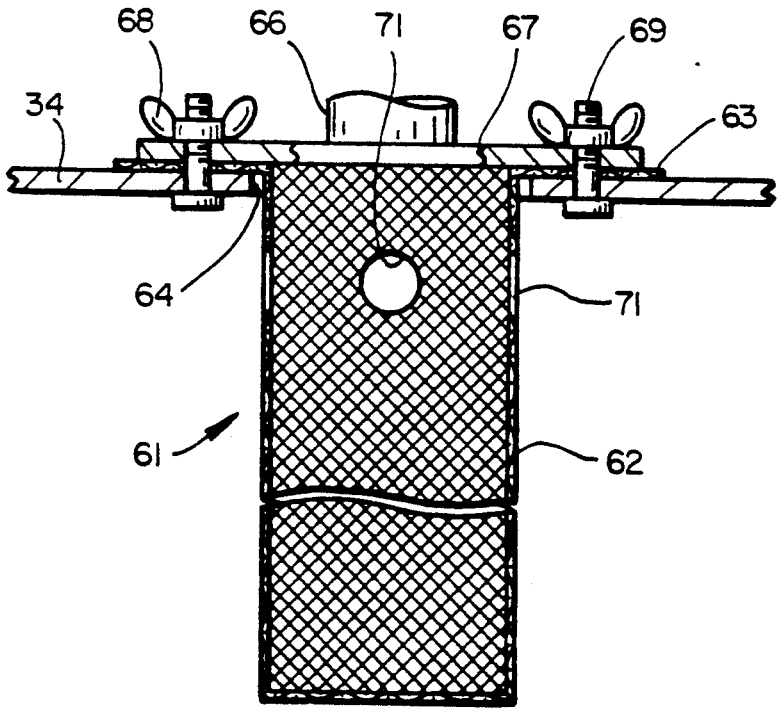
FIG. 5 is a centerline sectional view of a filter in the embodiment of FIG. 1.
Figure 6:
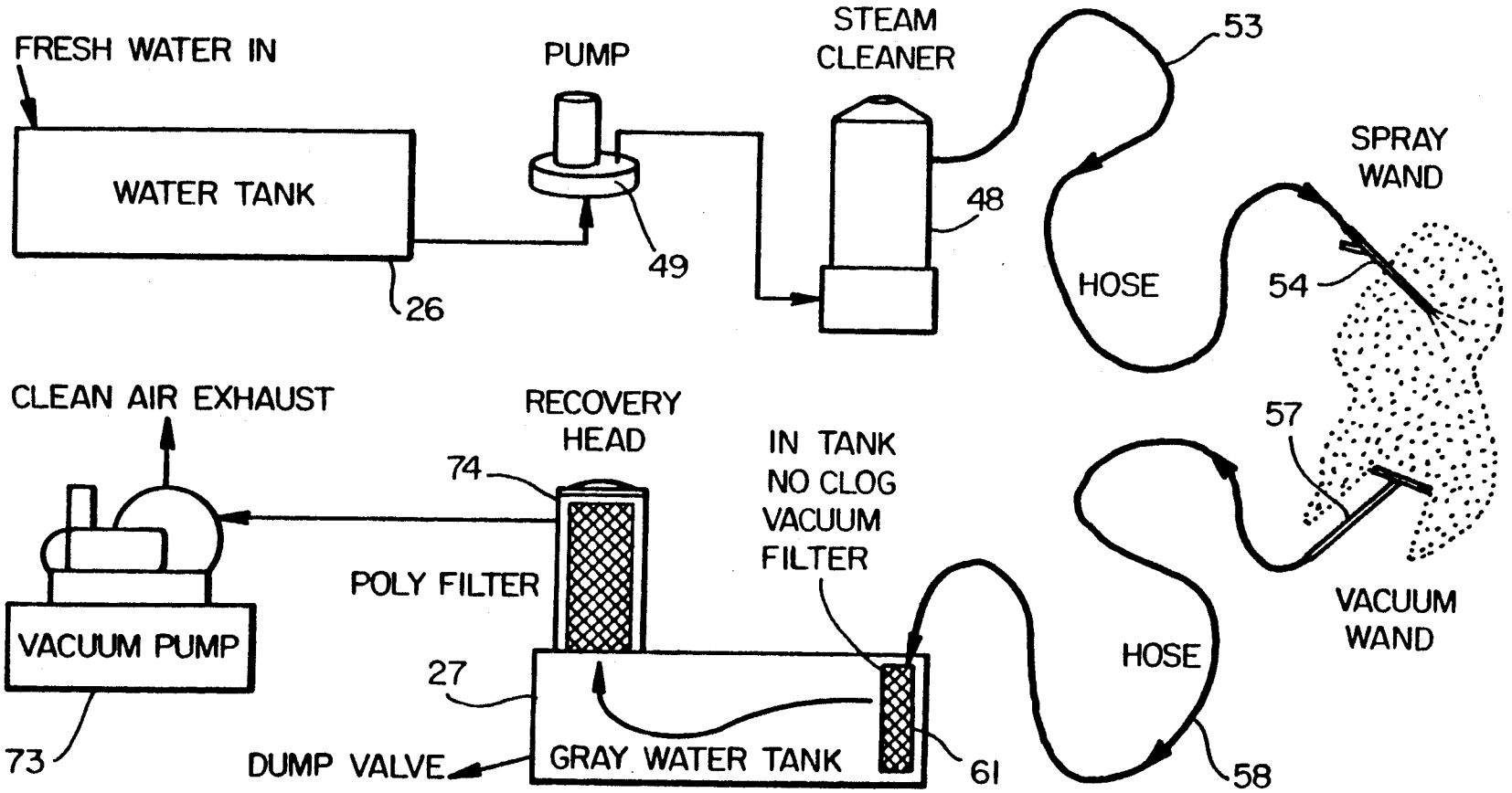
FIG. 6 is a flow diagram illustrating the operation of the embodiment of FIG. 1.

A filter 61 is provided at the inlet of the recovery tank for removing particulate residue or debris (e.g., sand, grass, broken glass, cigarette butts and the like) from the recovered water. As illustrated in FIG. 5, this filter comprises a cylindrical screen 62 having a mesh size or openings smaller than the particles to be removed, e.g. ⅛ inch, with an annular mounting flange 63 at the upper end thereof. The filter screen is removably mounted in an opening 64 in the top cover of the tank, with the mounting flange on the upper side of the cover. The pick-up hose is connected to the tank by a hose 66 from the storage reel, and the mounting flange of the filter is clamped between a flange 67 at the end of the connector hose and the cover of the tank. The hose flange and filter are held in place by wing nuts 68 on mounting bolts or studs 69 which project from the top cover.

The filter includes means for bypassing particulate residue around the filter when the filter is full to prevent clogging of the pick-up wand and hose. This means includes a plurality of bypass ports or openings 71 toward the upper end of the filter. In the embodiment illustrated, four such openings are provided, and they are spaced in quadrature around the upper portion of the side wall of the filter screen. These opening have a diameter greater than the size of the largest anticipated residue particles, e.g. ¾ inch, and when the residue builds up in the filter to the level of the openings, further residue passes through them into the recovery tank from which it is removed when the tank is cleaned.

Water and residue from the paved surface are drawn into the pick-up wand and hose and then into the recovery tank and filter by a vacuum pump 73 connected to the recovery tank through an air filter 74. The vacuum pump is mounted on the supply tank, and the air filter is mounted in an opening in the top cover of the recovery tank. The air filter protects the vacuum pump from moisture and other contamination and is preferably fabricated of a material such as polyethylene which will not be damaged if it gets wet. In the embodiment illustrated, the vacuum pump is driven by a gasoline engine and provides vacuum pressures on the order of 80–83 inches of water.

Figure 7:
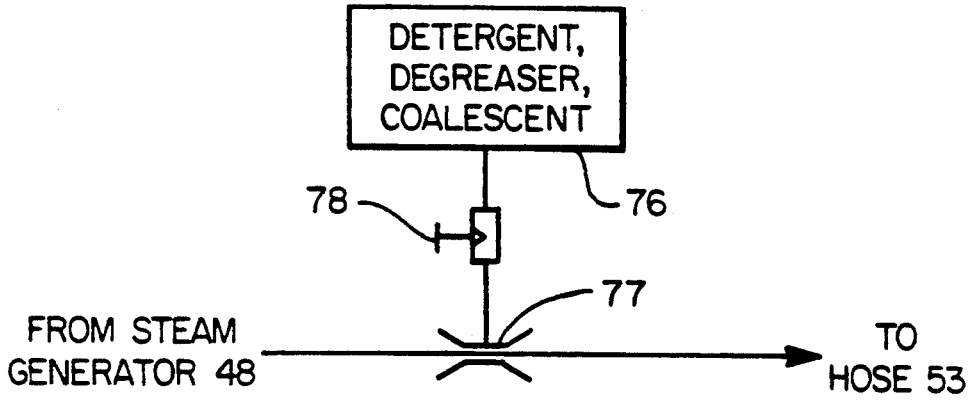
FIG. 7 is a schematic diagram of a system for employing a detergent, degreaser, coalescent or other cleaning agent in the embodiment of FIG. 1.

If desired, an agent such as a detergent, a degreaser or a coalescent can be added to the hot water and steam to enhance the cleaning process. As illustrated in FIG. 7, the agent is introduced into the hot water and steam at the output of the steam generator. The agent is stored in a tank 76 and is introduced into the hot water stream through a venturi 77 connected to the output of the pump in the steam generator, with a needle valve 78 for controlling the amount of agent which is introduced. Alternatively, if desired, the agent can be mixed with the water in supply tank 27, rather than injecting it into the heated and pressurized stream through the venturi.

In operation and use of the machine, pressurized hot water and steam from the steam generator are directed against the surface to be cleaned by spray wand 54 to loosen and dislodge oil, grease and/or other residue. The water (including condensed steam) and the dislodged residue are then vacuumed up with the pick-up wand and delivered to the recovery tank, where solid residue particles are removed from the recovered water by filter 61. In the event that the filter becomes filled with such particles, further residue particles pass through openings 71 and thus bypass the filter to prevent clogging of the pick-up wand and hose.

In addition to applications for removing residue such as oil and grease from the road, the machine is also useful in cleaning up spills of materials such as diesel fuel and oil. The spilled material can be diluted with water from the steam cleaner, then vacuumed up into the recovery tank.

The machine has a number of important features and advantages. The pressurized water and steam have been found to be very effective in removing oil and grease residues which other street cleaning machines have not been able to remove. The integral frame and body structure simplifies construction and helps to keep the center of gravity and profile of the unit as low as possible. The ability of the filter to prevent clogging of the pick-up wand and hose avoids the need to clean the hose and wand to remove blockages which could otherwise occur. The machine is environmentally sound in that the water used for cleaning is recovered along with the residue or debris and can be reused or disposed of in a proper manner. Although the machine has been disclosed with specific reference to the cleaning of streets and other paved surfaces, it can, if desired, also be employed in the cleaning of other objects and surfaces as well.

It is apparent from the foregoing that a new and improved machine for cleaning paved surfaces has been provided. While only certain presently preferred embodiments have been described in detail, as will be apparent to those familiar with the art, certain changes and modifications can be made without departing from the scope of the invention as defined by the following claims.

I claim:

1. In a machine for cleaning paved surfaces: a mobile supporting vehicle having water supply and recovery tanks forming an integral part of the vehicle, means mounted on the vehicle for pressurizing and heating water from the supply tank to produce steam and water at a pressure on the order of 2200–2500 psi, means for directing the pressurized water and steam against a surface to be cleaned, pick-up means connected to the recovery tank and adapted to be positioned in proximity to the cleaned surface, and means connected to the recovery tank for drawing water and residue from the surface through the pick-up means to the recovery tank.

2. The machine of claim 1 including a filter at the inlet of the recovery tank for removing particulate residue from the water.

3. The machine of claim 2 wherein the filter includes a filter element and means for bypassing the particulate residue around the filter element when particulate residue collected in the filter reaches a predetermined level.

4. The machine of claim 3 wherein the means for bypassing the residue around the filter includes a port in the upper portion of the filter of greater size than the largest particles in the residue.

5. The machine of claim 1 including means for adding an agent selected from the group consisting of a detergent, a degreaser, and a coalescent to the pressurized hot water.

6. In a mobile system for cleaning paved surfaces: a water supply tank, a recovery tank, a steam generator for heating water from the supply tank to produce highly pressurized hot water and steam, means including an elongated flexible hose connected to the steam generator for directing the hot water and steam against a surface to be cleaned, a pick-up wand and hose connected to the recovery tank, a vacuum pump connected to the recovery tank for drawing water and residue from the surface through the pick-up wand and hose to the recovery tank, and a filter in the recovery tank for separating the residue from the water, said filter including a filter element and means for bypassing excess residue around the filter element to prevent clogging of the pick-up hose by the excess residue.

7. The machine of claim 6 including means for adding an agent selected from the group consisting of a detergent, a degreaser, and a coalescent to the pressurized hot water.

8. In a machine for cleaning paved surfaces: a mobile support vehicle having an integral frame and body structure comprising a pair of longitudinally extending frame members, a water supply tank and a water recovery tank, each of said tanks being of generally rectangular cross-section and extending substantially the full length of the vehicle, with the two tanks being positioned side-by-side between the frame members and being rigidly affixed thereto to form the body of the vehicle, a steam generator mounted on the body formed by the tanks for heating water from the supply tank to produce highly pressurized water and steam, means connected to the steam generator for directing the pressurized water and steam against a surface to be cleaned, a pick-up hose connected to the recovery tank for removing water and residue from the cleaned surface, and a vacuum pump mounted on the body formed by the tanks and connected to the recovery tank for drawing water and residue from the surface through the pick-up hose to the recovery tank.

9. The machine of claim 8 including a filter at the inlet of the recovery tank for removing the residue from the water, said filter including a filter element and means for bypassing residue around the filter element in the event that the filter becomes filled with residue to prevent clogging of the pick-up hose by the residue.

10. The system of claim 9 wherein the filter comprises a vertically oriented cylindrical screen with openings smaller than particles of the residue, an inlet opening at the upper end of the screen, and a plurality of bypass openings of greater size than the particles of residue in the upper portion of the screen for passing residue particles directly from the inlet opening to the recovery tank when the residue builds up in the screen to the level of the bypass openings.

11. The machine of claim 9 including means for including an agent selected from the group consisting of a detergent, a degreaser, and a coalescent in the pressurized hot water.

12. In a mobile system for cleaning paved surfaces: a water supply tank, a recovery tank, a steam generator for heating water from the supply tank to produce highly pressurized hot water and steam, means including an elongated flexible hose connected to the steam generator for directing the hot water and steam against a surface to be cleaned, a pick-up wand and hose connected to the recovery tank, a vacuum pump connected to the recovery tank for drawing water and residue from the surface through the pick-up wand and hose to the recovery tank, and a filter in the recovery tank for separating the residue from the water, said filter comprising a vertically oriented cylindrical screen with openings smaller than particles of the residue, an inlet opening at the upper end of the screen, and a bypass opening of greater size than the particles of residue in the upper portion of the screen for passing residue particles directly from the inlet opening to the recovery tank when the residue builds up in the screen to the level of the bypass opening.

* * * * *